US009523490B2

(12) United States Patent
Kathawate et al.

(10) Patent No.: US 9,523,490 B2
(45) Date of Patent: Dec. 20, 2016

(54) REFLECTORS AND REFLECTOR ORIENTATION FEATURE TO PREVENT NON-QUALIFIED TRIM

(71) Applicant: Cooper Technologies Company, Houston, TX (US)

(72) Inventors: Jyoti Gururaj Kathawate, Smryna, GA (US); Evans Edward Thompson, III, San Francisco, CA (US); Russell Bryant Green, Douglasville, GA (US); Kevin Roy Harpenau, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/073,395

(22) Filed: Mar. 17, 2016

(65) Prior Publication Data

US 2016/0195255 A1 Jul. 7, 2016

Related U.S. Application Data

(63) Continuation of application No. 13/465,779, filed on May 7, 2012, now Pat. No. 9,291,319.

(51) Int. Cl.

| | |
|---|---|
| ***F21V 15/00*** | (2015.01) |
| ***F21V 29/70*** | (2015.01) |
| ***F21S 8/02*** | (2006.01) |
| ***F21V 29/503*** | (2015.01) |
| ***F21V 29/83*** | (2015.01) |
| *F21Y 101/00* | (2016.01) |

(52) U.S. Cl.

CPC ..... *F21V 29/70* (2015.01); *F21S 8/024* (2013.01); *F21S 8/026* (2013.01); *F21V 29/503* (2015.01); *F21V 29/83* (2015.01); *F21Y 2101/00* (2013.01)

(58) Field of Classification Search

CPC ..... F21V 29/70; F21V 29/503; F21V 29/83; F21V 17/10; F21V 17/002; F21V 17/005; F21V 17/06; F21S 8/024; F21S 8/026

USPC ..... 362/364

See application file for complete search history.

(56) References Cited

U.S. PATENT DOCUMENTS

| | | | | |
|---|---|---|---|---|
| 4,055,874 A | | 11/1977 | Brown | |
| 4,332,060 A | | 6/1982 | Sato | |
| 4,345,308 A | * | 8/1982 | Mouyard | G09F 13/22 362/245 |

(Continued)

OTHER PUBLICATIONS

Office Action mailed Aug. 24, 2016 for U.S. Appl. No. 13/746,835 mailed Aug. 24, 2016.

*Primary Examiner* — Bryon T Gyllstrom

(74) *Attorney, Agent, or Firm* — King & Spalding LLP

(57) ABSTRACT

The luminaire includes a light emitting diode (LED) module that includes a heat sink with an outer wall defining a top cavity and a bottom cavity and a mounting flange generally positioned along the bottom of the outer wall. A LED light source is positioned within the bottom cavity and in thermal communication with the heat sink. The bottom surface of the mounting flange includes one or more alignment features or keys extending out from the bottom surface. A trim having a corresponding alignment aperture is matingly engaged by positioning all or a portion of the alignment feature into the alignment aperture to ensure proper orientation of the trim with the LED module and to provide sufficient surface area for good thermal transfer between the heat sink and the trim.

19 Claims, 10 Drawing Sheets

(56) References Cited

U.S. PATENT DOCUMENTS

| | | | | |
|---|---|---|---|---|
| 5,584,575 | A | 12/1996 | Fickel | |
| 5,619,789 | A | 4/1997 | Chung | |
| 5,673,997 | A | 10/1997 | Akiyama | |
| 5,738,436 | A | 4/1998 | Cummings et al. | |
| 5,951,151 | A | 9/1999 | Doubeck et al. | |
| 6,305,829 | B1 | 10/2001 | Thomas et al. | |
| 6,979,107 | B1 * | 12/2005 | Benensohn | F21S 8/02 362/133 |
| 7,018,070 | B2 | 3/2006 | McCoy | |
| 7,120,969 | B2 | 10/2006 | Carls | |
| 7,438,433 | B1 | 10/2008 | Steadman et al. | |
| 7,487,584 | B1 | 2/2009 | Lee | |
| 7,959,332 | B2 | 6/2011 | Tickner et al. | |
| 8,070,328 | B1 | 12/2011 | Knoble et al. | |
| 8,096,670 | B2 | 1/2012 | Trott et al. | |
| 8,215,805 | B2 | 7/2012 | Cogliano et al. | |
| 8,220,970 | B1 * | 7/2012 | Khazi | F21V 29/004 362/294 |
| 8,348,477 | B2 | 1/2013 | Tickner et al. | |
| 8,405,947 | B1 | 3/2013 | Green et al. | |
| 8,445,144 | B2 | 5/2013 | Utsugi et al. | |
| 8,491,166 | B2 | 7/2013 | Thompson, III | |
| 8,500,305 | B2 | 8/2013 | O'Sullivan et al. | |
| 8,602,601 | B2 * | 12/2013 | Khazi | F21S 8/026 362/249.02 |
| 8,684,569 | B2 | 4/2014 | Pickard et al. | |
| 8,845,144 | B1 | 9/2014 | Davis et al. | |
| 9,062,866 | B1 | 6/2015 | Christ et al. | |
| 2005/0265016 | A1 | 12/2005 | Rappaport | |
| 2007/0147052 | A1 | 6/2007 | Wyatt | |
| 2008/0080195 | A1 * | 4/2008 | Steadman | F21V 17/06 362/364 |
| 2009/0086476 | A1 | 4/2009 | Tickner et al. | |
| 2009/0129086 | A1 | 5/2009 | Thompson | |
| 2010/0085759 | A1 | 4/2010 | O'Sullivan et al. | |
| 2010/0110699 | A1 * | 5/2010 | Chou | F21S 8/026 362/365 |
| 2010/0226139 | A1 * | 9/2010 | Lynch | F21S 8/02 362/373 |
| 2010/0246193 | A1 | 9/2010 | Clifton et al. | |
| 2011/0063849 | A1 * | 3/2011 | Alexander | F21S 48/328 362/294 |
| 2011/0297971 | A1 | 12/2011 | Shimizu | |
| 2012/0120645 | A1 | 5/2012 | Hawkins | |
| 2013/0010476 | A1 | 1/2013 | Pickard | |
| 2013/0294077 | A1 * | 11/2013 | Gabrius | F21S 8/026 362/241 |
| 2013/0294084 | A1 | 11/2013 | Kathawate et al. | |

* cited by examiner

REFLECTORS AND REFLECTOR ORIENTATION FEATURE TO PREVENT NON-QUALIFIED TRIM

CROSS REFERENCE TO RELATED APPLICATIONS

This non-provisional patent application is a continuation of and claims priority under 35 U.S.C. §120 to U.S. patent application Ser. No. 13/465,779, filed on May 7, 2012 and titled "Reflectors and Reflector Orientation Feature to Prevent Non-Qualified Trim," the entire contents of which is hereby fully incorporated herein by reference.

TECHNICAL FIELD

The present disclosure relates generally to light fixtures and trim for such fixtures.

BACKGROUND

A luminaire is a system for producing, controlling, and/or distributing light for illumination. For example, a luminaire can include a system that outputs or distributes light into an environment, thereby allowing certain items in that environment to be visible. Luminaires are sometimes referred to as "light fixtures." Traditional light fixtures include a frame and/or platform that attaches to a ceiling or wall structure. A trim-reflector element can be mounted to the frame for decorative or light control purposes. The types and styles of trims are typically more numerous than the fixtures that luminaires they are designed to attached to. This is because the trims are, at time, the only portion of the luminaire visible within the room being illuminated. As such there is a significant market for providing trims that couple to luminaires. At times these trims have not been specifically designed for the particular luminaire. This can result in a perceived lack of performance from the luminaire, when the real issue is the trim that is being used with the luminaire. As such, providing a mechanism for ensuring proper trims and/or proper orientation of the trim on the luminaire would limit this perceived lack of performance.

SUMMARY

According to one exemplary aspect, a luminaire can include a light emitting diode (LED) light source, a heat sink, and a trim. The heat sink can be coupled to the LED light source and can include an alignment feature protruding from a bottom end of the heat sink. The trim can include a first aperture, a second aperture and a wall disposed between the first and second aperture, such than an inner surface of the wall can define a light passageway for receiving light emitted by the LED light source. The trim can also include an alignment aperture at a top end of the wall of the trim, the alignment aperture corresponding to the size and shape to the alignment feature of the heat sink. The heat sink can be removably coupled to the trim when the alignment feature matingly engages the alignment aperture.

According to another exemplary aspect, a trim for a recessed light fixture can include a top wall, a bottom wall and a trim body. The top wall can be at an upper end of the trim and can include a first aperture for receiving a LED light source and an alignment feature for engaging a corresponding heat sink alignment feature. The bottom wall can be at a lower end of the trim and can include a second aperture for emitting light received at the first aperture and a trim ring extending laterally outward from the lower end adjacent to the bottom wall. The trim body can be disposed between the upper end and the lower end of the trim, the trim body.

According to still another exemplary aspect, a luminaire can include a heat sink and a trim element. The heat sink can include a flange at a bottom end of the heat sink, a notch at a bottom surface of the flange, and a ramped surface at the flange proximate the notch. The trim can include a light receiving aperture at a top end of the trim, a light emitting aperture at a bottom end of the trim, and an alignment feature extending in the direction between the top end and the bottom end of the trim, the alignment feature corresponding in size and shape to the notch. The heat sink can be coupled to the trim when a bottom surface of the alignment feature engages the ramped surface.

These and other aspects, features, and embodiments of the invention will become apparent to a person of ordinary skill in the art upon consideration of the following detailed description of illustrated embodiments exemplifying the best mode for carrying out the invention as presently perceived.

BRIEF DESCRIPTION OF THE DRAWINGS

For a more complete understanding of the exemplary embodiments of the present invention and the advantages thereof, reference is now made to the following description in conjunction with the accompanying drawings, which are described below.

Figure 1:
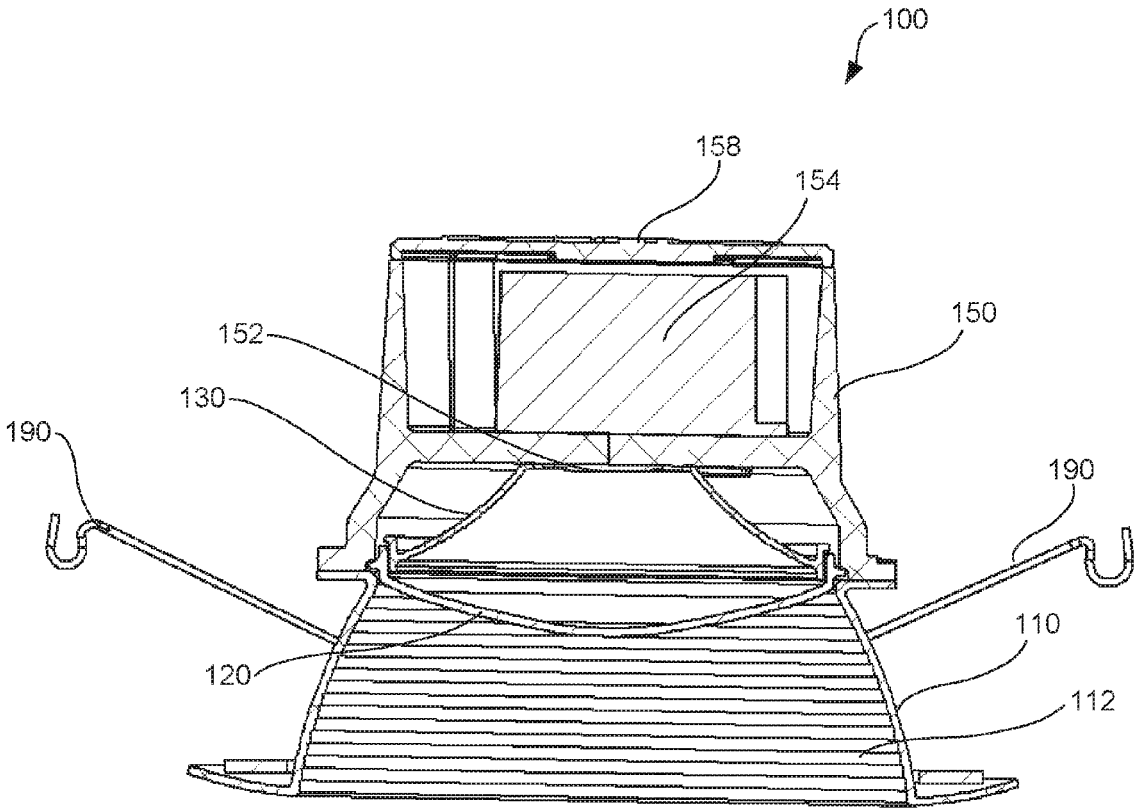
FIG. 1 is a side cross-sectional view of an LED-based lighting system according to an exemplary embodiment.

The drawings illustrate only exemplary embodiments of the invention and are therefore not to be considered limiting of its scope, as the invention may admit to other equally effective embodiments. The elements and features shown in the drawings are not necessarily to scale, emphasis instead being placed upon clearly illustrating the principles of exemplary embodiments of the present invention. Additionally, certain dimensions may be exaggerated to help visually convey such principles. In the drawings, reference numerals designate like or corresponding, but not necessarily identical, elements.

DETAILED DESCRIPTION OF THE EXEMPLARY EMBODIMENTS

The exemplary embodiments described herein are directed to systems and devices for a light fixture assembly and a method of assembling the same. The exemplary luminaire systems described herein include a LED lamp module and a trim/reflector removably coupled to the LED lamp module. As described herein the exemplary LED lamp module includes a heat sink having cavities on the top and bottom end. The cavity on the bottom end includes one or more LEDs coupled to a surface of the heat sink. LEDs can include discrete LEDs, LEDs disposed on a printed circuit board, or chip-on-board LEDs as that term is used by those of ordinary skill in the art. The cavity on the bottom end of the heat sink can also include a lens that covers a majority of the cavity and the LEDs. The lens can be transparent, translucent or shaded a particular color. The cavity on the top end can include an LED driver or other electrical components for providing power and control signals to the LEDs.

Certain of the various components described herein are designed such that only a "qualified" trim, i.e., a trim having appropriate features to properly mate with the LED module, can be coupled to the heat sink of the LED module. An exemplary light fixture also includes a directional trim element, e.g., gimbal trim mount, for directing the light beam emitted by the LEDs in the light fixture. While the exemplary embodiments described herein are generally for recessed lighting fixture applications, it should be understood that the disclosure and each of the exemplary embodiments described herein are not limited to recessed configurations.

Exemplary embodiments of lighting systems now will be described more fully hereinafter with reference to the accompanying drawings, in which exemplary embodiments of lighting systems and components are shown. The lighting systems may, however, be embodied in many different forms and should not be construed as limited to the exemplary embodiments set forth herein; rather, these exemplary embodiments are provided so that this disclosure will be thorough and complete, and will fully convey the scope of lighting systems to those or ordinary skill in the art. Like, but not necessarily the same, elements in the various figures are denoted by like reference numerals for consistency.

FIG. 1 is a cross-sectional side view of an LED-based system or luminaire 100 in accordance with one or more exemplary embodiments. The exemplary system 100 includes a trim 110 removably coupled to a heat sink portion 150 of an LED module. The heat sink portion 150 of the LED module includes a lower cavity and an upper cavity, with a mounting surface disposed between the lower cavity and upper cavity. An LED light source 152 is coupled to a bottom side of the mounting surface of the heat sink 150. For example, a chip-on-board LED or a PCB having multiple LEDs disposed thereon can be coupled to the bottom surface of the mounting surface. The exemplary LED light source 152 is positioned close enough to the heat sink 150 so that some or all of the heat generated by the LED light source 152 is absorbed by or conducted to the heat sink 150.

In certain exemplary embodiments, an upper reflector 130 is positioned at least partially within the lower cavity. The upper reflector 130 has an upper opening at a first end and a lower opening at a distal second end. In certain exemplary embodiments, the upper opening is disposed about the LED light source 152, with the first end of the upper reflector 130 being coupled to the mounting surface of the heat sink 150. Alternatively, the upper reflector 130 is coupled to a lens 120. The upper reflector 130 may be coated with a reflective material. The reflective material of the upper reflector 130 may be the same material or different material from the reflective material used for the trim 110. The upper reflector 130 may be made of one or more of a number of suitable materials, including but not limited to aluminum, alloy, and glass.

The exemplary lens 120 is at least partially disposed within the lower cavity of the heat sink 150 and coupled to the heat sink 150 adjacent to a bottom surface of the heat sink 150. Alternatively, the lens 120 is coupled to or against the upper reflector 130 using the trim 110, the heat sink 150, and/or a separate fastening mechanism (not shown). The exemplary lens can be transparent, translucent or tinted a particular color. The lens 120 may be constructed of one or more of a number of suitable materials, including, but not limited to, glass and plastic. In certain exemplary embodiments, the lens 120 is constructed of plastics such as polycarbonate and acrylic.

In one or more exemplary embodiments, the trim 110 receives light emitted from the LED 152 through the lens 120 and directs that light into an area to be illuminated. As a byproduct of converting electricity into light, LEDs generate a substantial amount of heat that raises the operating temperature of the system 100 if allowed to accumulate. As such, the LED light sources 152 are thermally coupled, and in certain exemplary embodiments directly coupled, to the heat sink 150. The heat sink 150 conducts heat away from the LEDs and the LED driver dispose in the upper cavity of the heat sink 150, even when the system 100 is installed in an insulated ceiling environment. In addition to the heat sink 150, the trim 110 may also be used as part of the thermal management system.

The exemplary trim 110 includes a top mounting flange 122 that is disposed adjacent to or abuts a corresponding bottom surface of a mounting flange of the heat sink 150 and places the trim in thermal communication with the heat sink 150. The trim 110 also includes a side wall (see FIG. 3A, 118) that generally extends down from the top mounting flange 122. In certain exemplary embodiments, the side wall includes an inner surface that is parabolic or substantially parabolic. Alternatively, the inner surface of the side wall can be frusto-conical, conical, or spherical. The side wall can include a baffle 112 design throughout some or all of the inner surface or outer surface of the side wall. Alternatively, the inner surface of the side wall can be smooth and reflective. In yet another alternative embodiment, the trim 110 may include a splay (not shown) design and/or a wall wash design. The trim 110 conducts heat from the heat sink 150 by way of the contact surface area between the top mounting flange 122 and the mounting flange of the heat sink. The side wall acts as a heat path from the heat sink 150 to dissipate heat into the area to be illuminated, such as a room or hallway. By using the trim 110 as a heat-conductive path from the heat sink 150 to the area to be illuminated, certain components known in the art may be eliminated from the system 100. For example, an additional heat sink (not shown), coupled to the heat sink 150, may be eliminated. Alternatively, or in addition, the heat sink 110 profile may be altered (e.g., shorter height, heat sink fins eliminated).

The lower end of the trim 110 (i.e., the end furthest away from the heat sink 150) may be approximately flush with a mounting surface (e.g., ceiling, wall). Alternatively, the lower end of the trim 110 may extend beyond the mounting surface or be recessed behind the mounting surface. The trim 110 can be composed of a material for reflecting, refracting, transmitting, or diffusing light emitted by the LED light source 152. The trim may be made of one or more of a number of suitable materials, including but not limited to aluminum, plastic, and glass. Further, the trim 110 may be decorative, having one or more of a number of colors or designs to increase the aesthetic value of the system 100. For example, the trim 110 may be in a color that matches the décor of an environment in which the system 100 is placed. In an exemplary embodiment, the inner surface of the trim 110 may have a reflective coating or material (e.g., white paint, glass).

In one or more exemplary embodiments, the heat sink 150 receives heat from the LED light sources and the LED driver and dissipates the heat partially behind the wall and partially into the area to be illuminated, by way of the trim 110. The heat sink 150 may be made of any suitable material (e.g., aluminum, metal alloy) adapted to absorb and dissipate heat. The exemplary heat sink 150 is a single piece construction (e.g., die cast). Alternatively, the heat sink 150 is an assembly of multiple pieces. The heat sink 150 may include a top plate 158, which may be removable to allow access to the LED driver 154 and/or other components that are positioned within the upper cavity that is defined by an inner surface of an outer wall of the heat sink 150. The top plate 158 may be coupled to the outer wall of heat sink 150 using one or more of a number of fastening methods, including but not limited to threaded couplings, a clamp, and threaded fasteners.

In one or more exemplary embodiments, the LED driver 154 provides power and/or control signals for the LED light source 152. Specifically, the LED driver 154 receives power from an AC power source, processes the power, and delivers the processed power to the LED light source 152, typically in the form of direct current (DC) power. In addition, the LED driver 154 may also receive, process, and/or deliver control signals to the LED light source 152. While the exemplary LED driver 154 is shown coupled to the heat sink 150 and positioned within the upper cavity, alternatively, the LED driver 154 may be located remote from the heat sink 150 or coupled to an exterior surface of the heat sink 150.

The heat sink 150 may also include a friction clip mounting post 156 and/or torsion springs 190. The friction clip mounting post 156 and/or torsion springs 190 may be configured to secure the LED-based lighting system 100 to a housing (not shown) inside of which the LED-based lighting system 100 is mounted.

Figure 2:
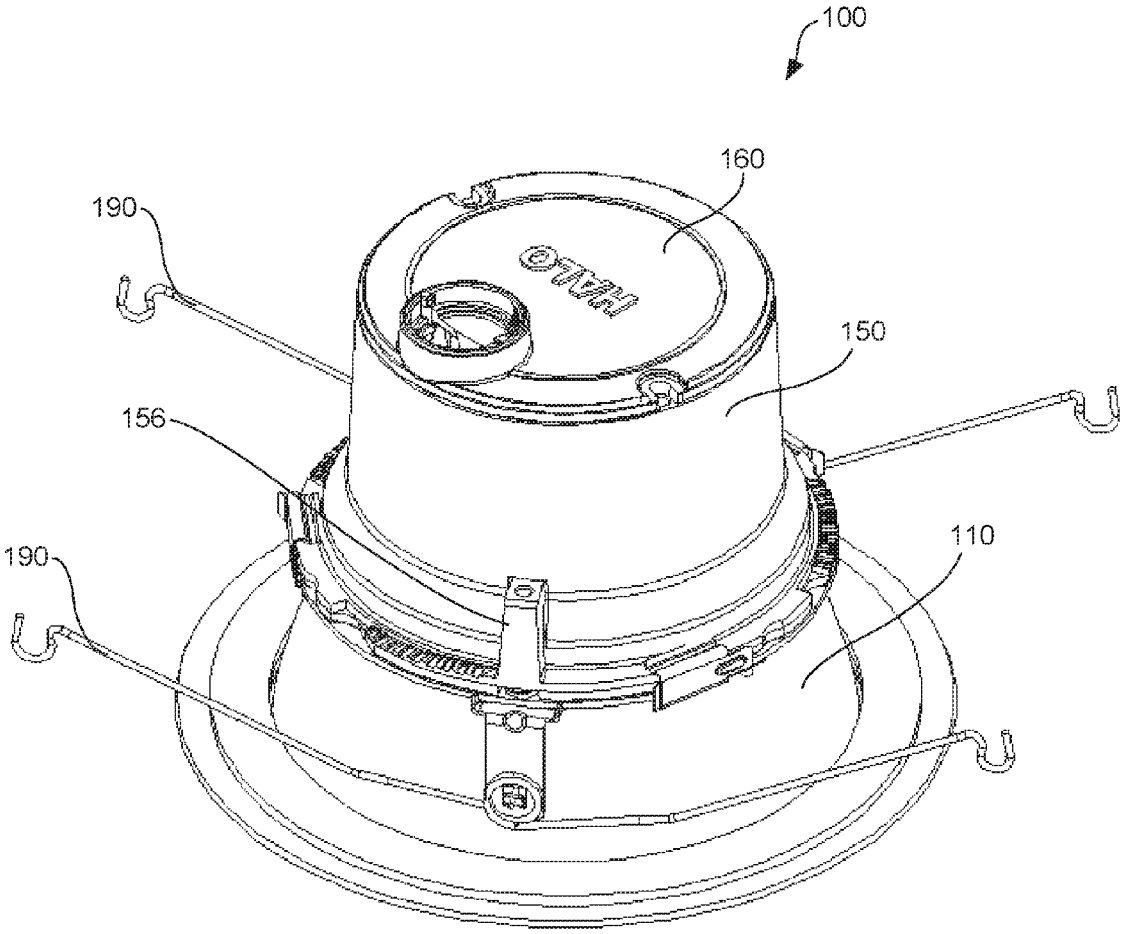
FIG. 2 is a perspective view of the LED-based lighting system of FIG. 1 according to one embodiment.

FIG. 2 is a perspective view of the exemplary LED-based lighting system 100. As illustrated in FIG. 2, the system 100 includes the trim 110 coupled to the heat sink 150 of the LED module as described with respect to FIG. 1.

Figure 3A:
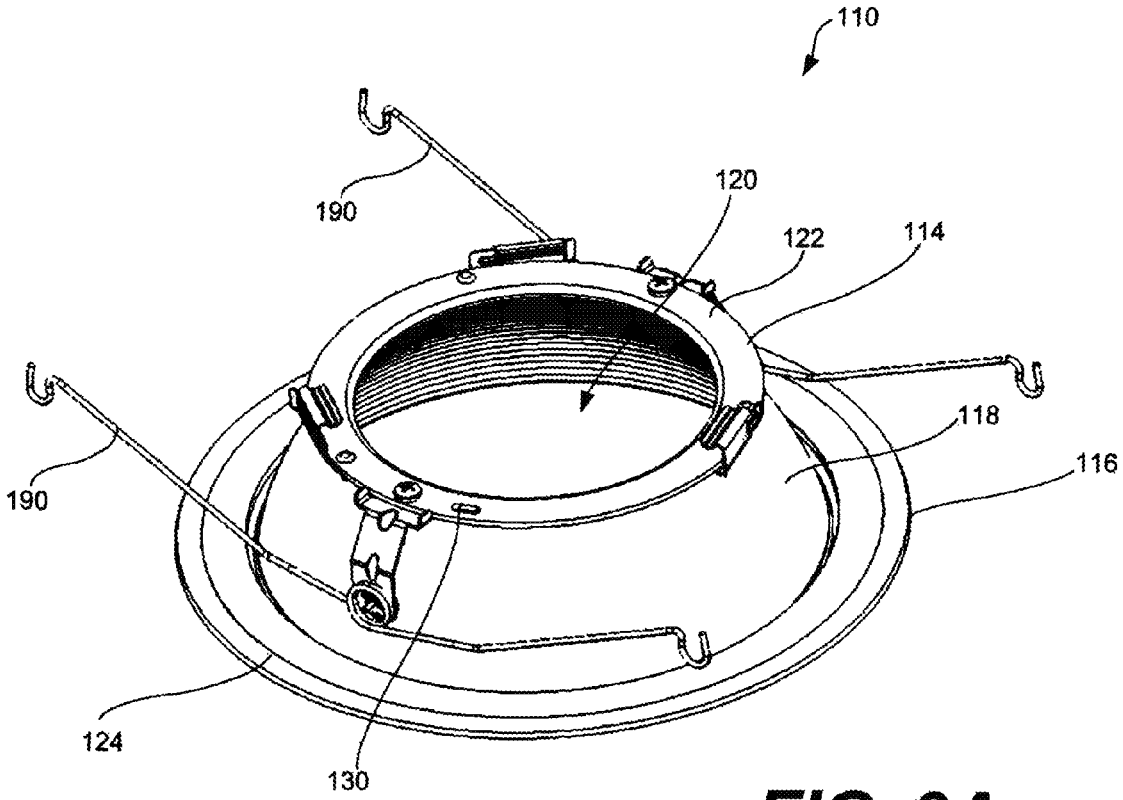
FIG. 3A is a perspective view of a trim element according to an exemplary embodiment.
Figure 3B:
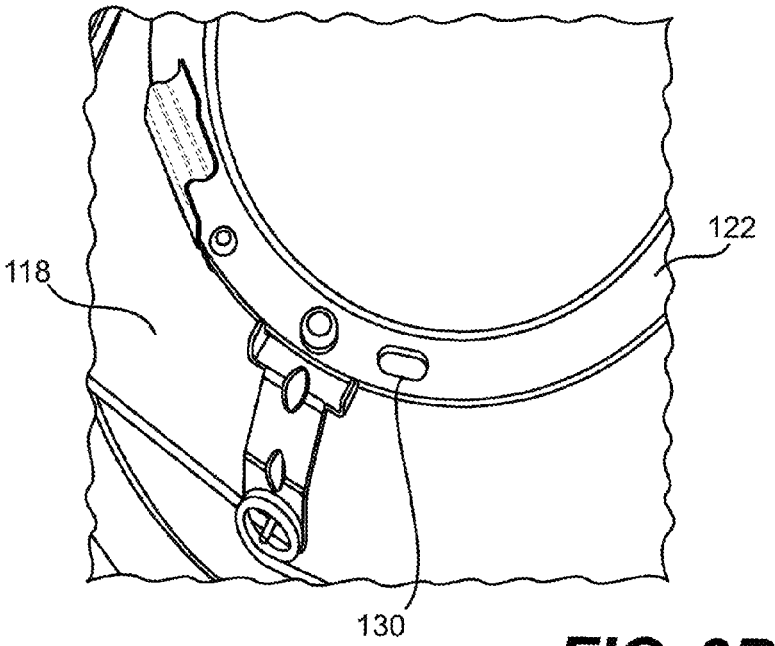
FIG. 3B is a partial perspective view of the trim element of FIG. 3A according to one exemplary embodiment.

FIG. 3 is a perspective view of a trim element 110 in accordance with one or more exemplary embodiments. While the exemplary trim 110 is shown having a particular shape, the shape of the trim 110 is not a limiting factor in the design and those of ordinary skill in the art will recognize that other shapes for the trim 110 including, but not limited to, parabolic, frusto-conical, conical, and spherical, as discussed above, are within the scope and spirit of this disclosure. Referring now to FIGS. 1, 3A and 3B, the exemplary trim 110 includes a first end 114, a distal second end 116, and a side wall 118 extending between the first end 114 and the second end 116. The first end 114 defines an aperture 120 through which an LED light source 152 emits light. The second end 116 defines an aperture (not shown) through which the light emitted from the LED projects into the area to be illuminated of the system 100. The aperture 120 and the aperture defined by the second end 116 can have any suitable shape, such as round, rectangular, triangular, or oval, for use with the LED light source 152. The direction of the light path emitted from the LED light source 152 defines the beam path of the LED light source 152. In an exemplary embodiment, the beam path runs parallel or substantially parallel through the centerline of the system 100.

In an exemplary embodiment, the second end 116 of the trim 110 includes a bottom flange 124 (i.e., trim ring) that extends from the side wall 118 orthogonally or substantially orthogonally to the beam path of the LED light source 152. Alternatively, the bottom flange extends upward from the bottom edge of the side wall 118 at an angle between 1 and 30 degrees. All or a portion of the bottom flange 124 can be flush with the mounting surface (e.g., ceiling, wall) when the lighting system 100 is installed. In an alternate embodiment, the bottom flange 124 is recessed behind the mounting surface. In another alternative embodiment, the bottom flange 124 extends beyond the mounting surface and covers any gap or imperfection in the mounting surface proximate the trim 110. For example, the bottom flange 124 can cover the edge of the hole formed in the ceiling/wall for receiving the trim 110.

In an exemplary embodiment, the first end 114 of the of the trim 110 includes a top flange 122 that extends from the side wall 118 orthogonally or substantially orthogonally to the beam path of the LED 152. The top flange 122 include one or more alignment holes 130. An exemplary alignment hole 130 aligns and holds the trim 110 in place with respect to a corresponding alignment key 160 that extends out from a bottom surface of the mounting flange of the heat sink 150. In certain exemplary embodiments, the alignment hole 130 is a through-hole. In an alternate embodiment, the alignment hole 130 does not extend through the entire thickness of the top flange 122. Instead, the alignment hole 130 comprises a hollow or depression in the surface of the top flange 122.

In an exemplary embodiment, top flange 122 can include more than one alignment hole 130. In this embodiment, the spacing, number, and/or shape of the various alignment holes can differ. For example, in an exemplary embodiment, the top flange 122 can include two differently-shaped alignment holes 130, spaced apart 10 degrees from one-another around the circumference of the top flange 122. In an alternate embodiment, the shape and spacing of the alignment holes 130 may be consistent. For example, the top flange 122 can include three identically-shaped or differently-shaped alignment holes 130, each spaced apart 120 degrees from one-another around the circumference of the top flange 122.

Figure 4A:
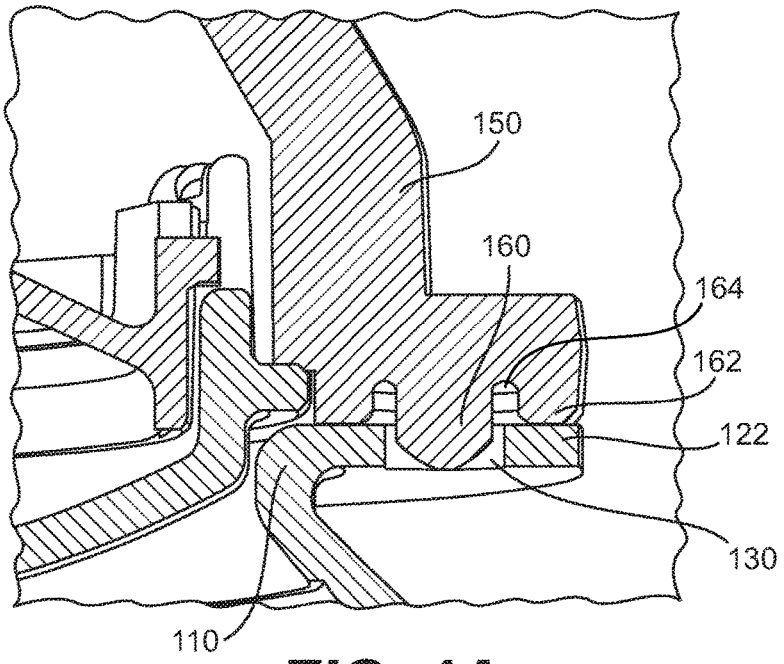
FIG. 4A is a partial cross-sectional view of a LED-based lighting system according to an exemplary embodiment.
Figure 4B:
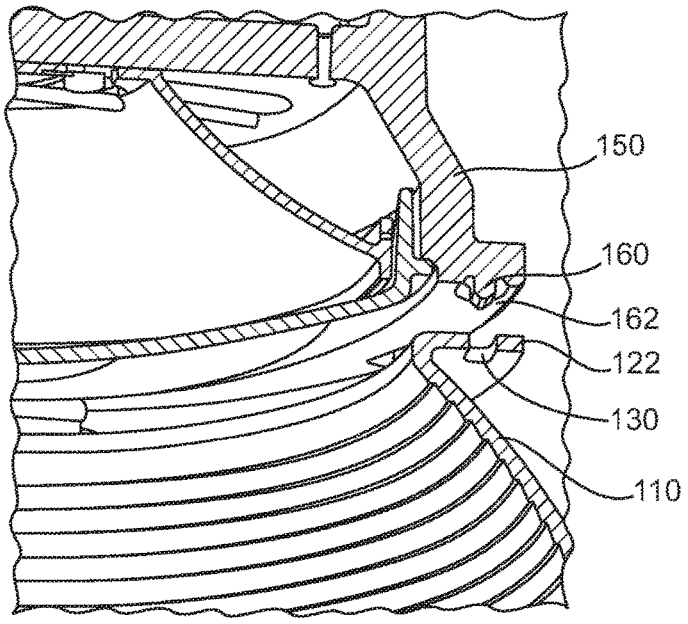
FIG. 4B is a perspective partial cross-sectional view of the LED-based lighting system of FIG. 4A according to one exemplary embodiment.

As illustrated in FIGS. 4A and 4B, the alignment hole 130 aligns with a corresponding alignment key 160 of the heat sink 150. The insertion of the alignment key 160 into the alignment hole 130 rotationally fixes the location of the trim 110 and heat sink 150 with respect to each other. In an exemplary embodiment, mating of the alignment hole 130 and the alignment key 160 is utilized when assembling or otherwise coupling the trim 110 to the heat sink 150.

FIG. 4A provides a partial cross-sectional view of the alignment key 160 mating with the alignment hole 130 according to an exemplary embodiment. Similarly, FIG. 4B is an exploded partial perspective cross-sectional view of the alignment key 160 lined up with the alignment hole 130. In an exemplary embodiment, the shape of the alignment hole 130 corresponds to the shape of the alignment key 160 such that the alignment key 160 matingly couples with or is slidably inserted into the alignment hole 130. The alignment hole 130 and/or alignment key 160 can have any suitable shape, such as, for example, round, elliptical, rectangular, triangular, or oval.

As illustrated in FIGS. 4A and 4B, an exemplary heat sink 150 includes an alignment key 160. The alignment key 160 extends downward from the bottom surface 162 of the mounting flange of the heat sink 150 in the direction of the light path, towards the top surface of the top flange 122. The alignment key 160 may extend in a direction orthogonal or substantially orthogonal to the bottom surface 162 of the mounting flange of the heat sink 150. In an exemplary embodiment, the alignment key 160 is integrally formed with the heat sink 150. For example, the alignment key 160 is formed when molding, casting, milling, or otherwise forming the heat sink 150. In an alternate embodiment, the alignment key 160 is formed separate from the heat sink 150 and coupled to the heat sink 150 at the bottom surface 162, such as by welding or brazing. In an exemplary embodiment, the bottom surface 162 includes a channel 164 around the perimeter of the alignment key 160. An exemplary channel 164 can border the entire perimeter of the alignment key 160 or a portion of the perimeter of the alignment key 160. The channel 160 can ensure proper mating and alignment of the alignment key 160 with the alignment hole 130. The exemplary alignment key 160 has an elliptical or "hot-dog" shape and extends out from the bottom surface of the mounting flange of the heat sink 150 about one-quarter of an inch (see FIGS. 5A and 5B). As illustrated in FIGS. 4A and 4B, the bottom portion of the exemplary alignment key 160 includes a chamfered edge to reduce the surface area along the bottom-most surface of the key 160 to facilitate engagement with and insertion into the alignment hole 130. In an alternate embodiment, the bottom portion of the alignment key may include a round or square edge.

Figure 5A:
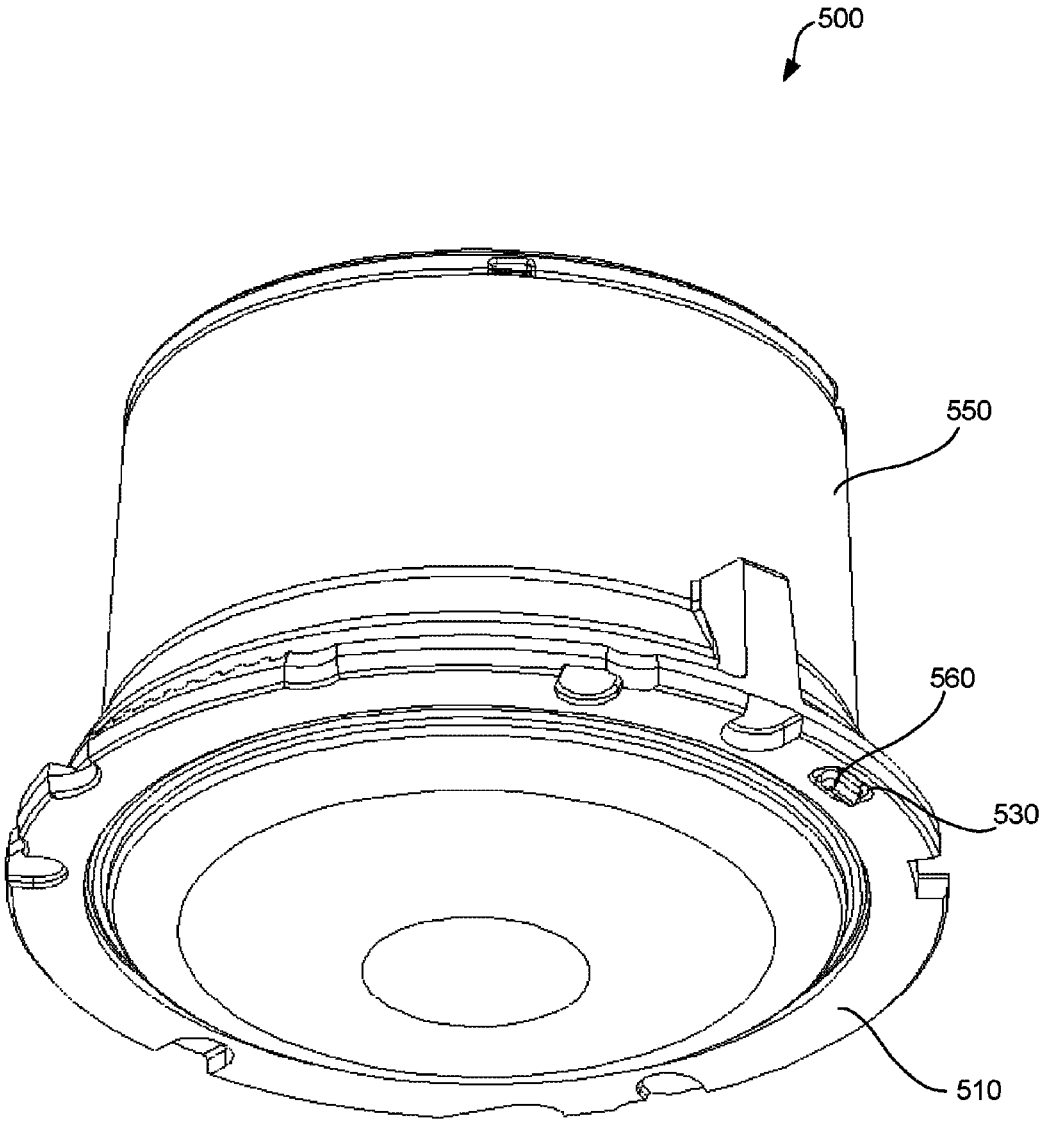
FIG. 5A is a perspective view of an LED-based lighting system according to an exemplary embodiment.
Figure 5B:
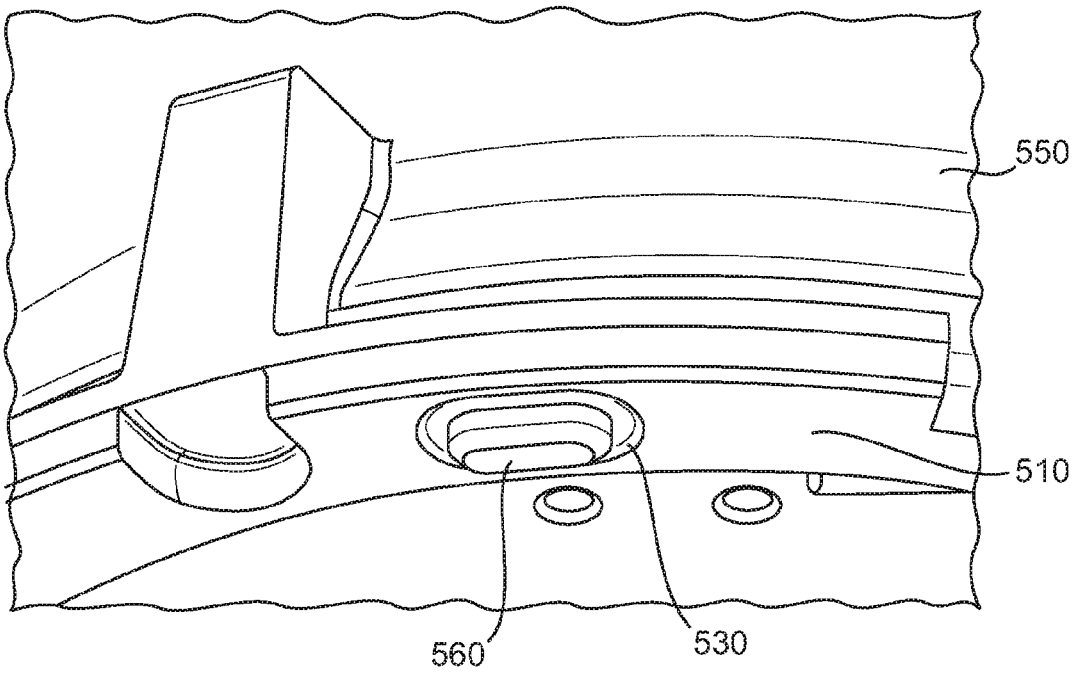
FIG. 5B is a partial perspective view of the LED-based lighting system of FIG. 5A according to one exemplary embodiment.

FIG. 5A is a perspective view of a LED-based lighting system 500 in accordance with an exemplary embodiment. FIG. 5B is a partial perspective view of the exempalry LED-based lighting system 500 of FIG. 5A. Referring now to FIGS. 5A and 5B, the exemplary lighting system 500 includes a trim 510 coupled to a heat sink portion 550 of the LED module. As illustrated in FIGS. 5A and 5B, the alignment key 560 is engaged and mated with the alignment hole 530 when the heat sink 550 and the trim 510 are coupled.

Figure 6:
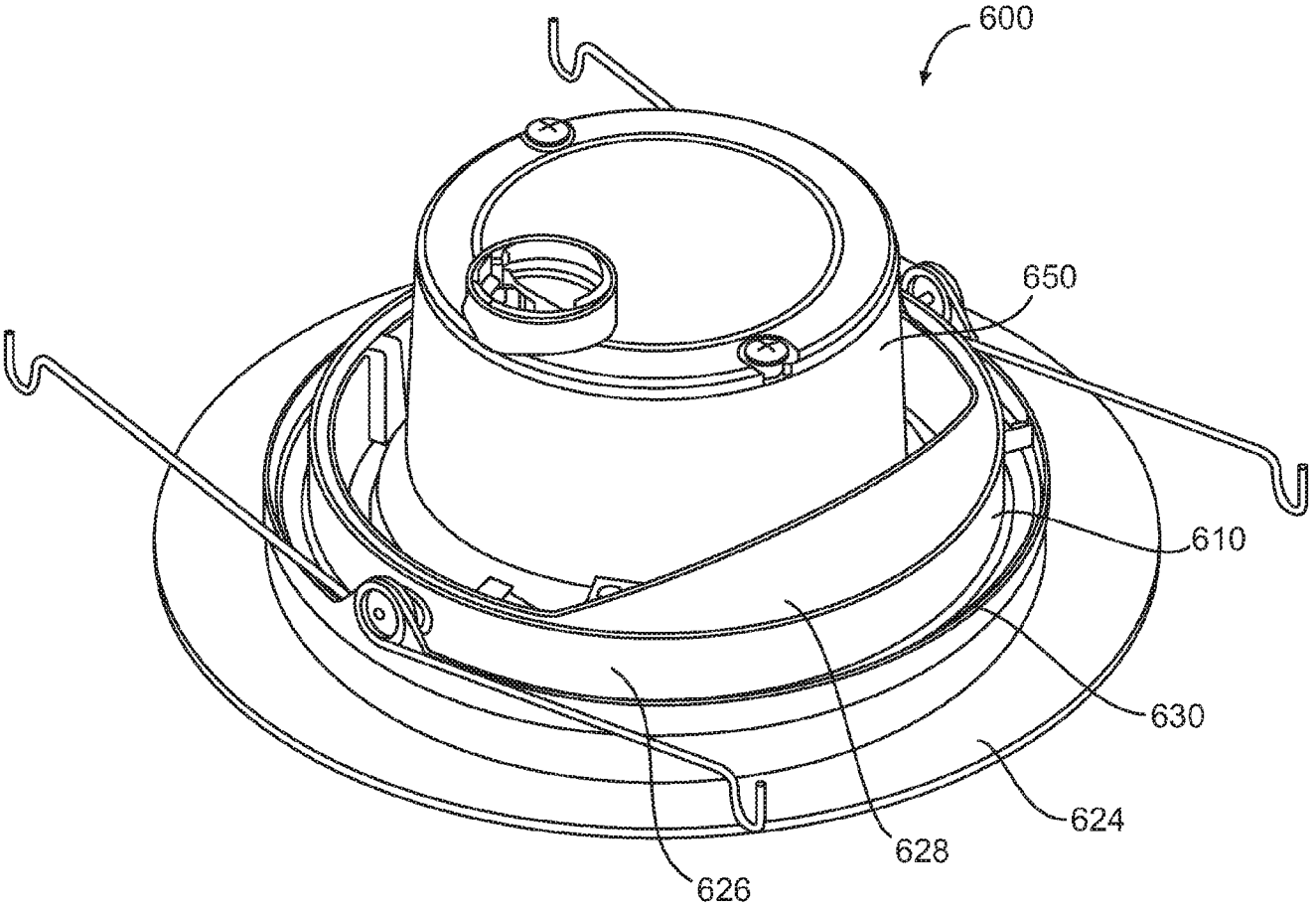
FIG. 6 is a perspective view of an LED-based lighting system including a gimbal trim mount according to an exemplary embodiment.

FIG. 6 is a perspective view of a LED-based lighting system 600 including an adjustable gimbal trim unit. In certain exemplary embodiments, the lighting system 600 includes a gimbal trim unit 610 for directing the light path of the LED. The heat sink 650 is mounted to the gimbal trim unit 610 and the LED/heat sink 650 is movable in relation to the bottom flange 624 so that the LED module may be tilted to control the elevation of the light path and swiveled to control the azimuth (rotational) position of the light path.

Figure 7A:
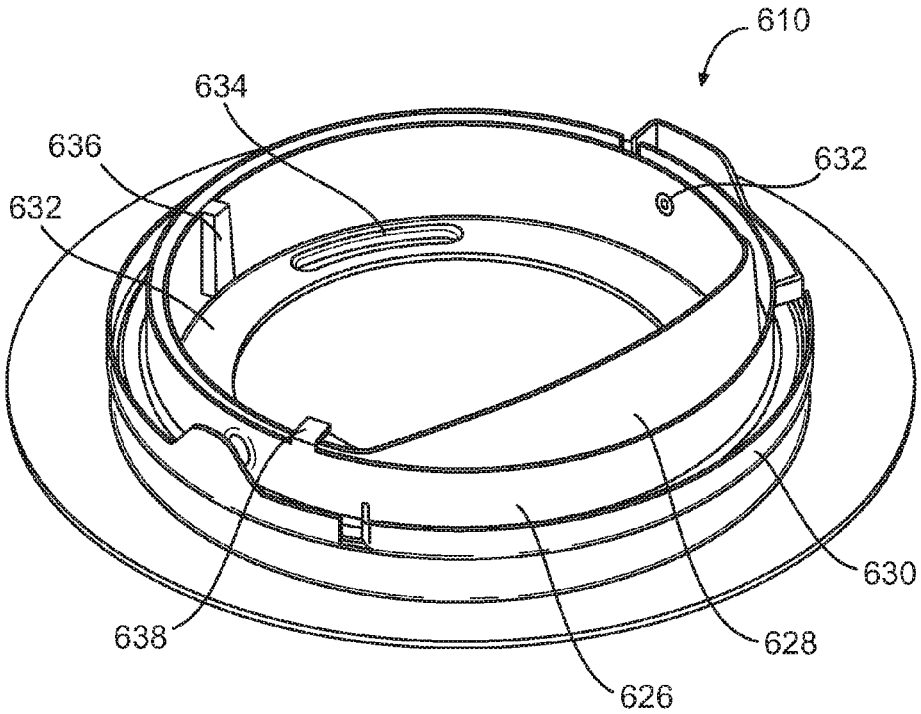
FIG. 7A is a perspective view of a gimbal trim mount according to an exemplary embodiment.
Figure 7B:
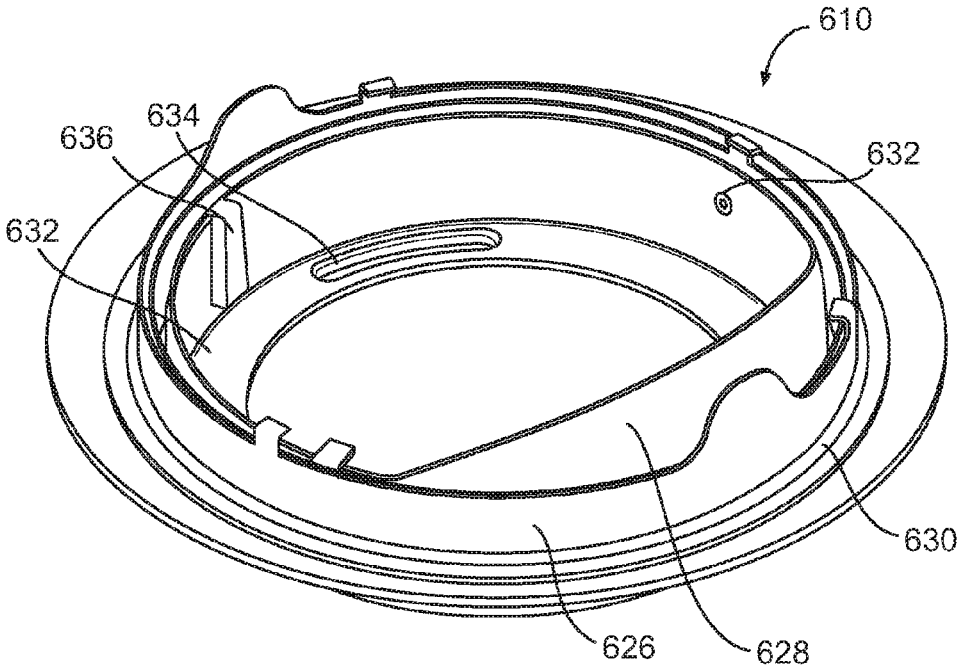
FIG. 7B is a perspective view of a gimbal trim mount according to an exemplary embodiment.

The gimbal trim unit 610 includes a bottom flange 624 (i.e., trim ring), a rotational collar 626, an inner collar 628, and a gimbal mounting flange 630. As illustrated in the perspective view of the exemplary gimbal trim unit 610 depicted in FIGS. 7A and 7B, rivet 632 provides a pivot point for tilting the gimbal trim unit 610. The rivet 632 fixedly connects the rotational collar 626 with the inner collar 628. In an exemplary embodiment, the rotational collar 626 includes a tab 638 that extends from the top surface of the rotational collar 626 in a direction towards the centerline of the gimbal trim unit 610 orthogonally or substantially orthogonally to the direction of the beam path. The tab 638 extends over the top surface of the inner collar 628 to limit the tilt angle of the inner collar 628. An exemplary inner collar 628 includes one tab 638. In an alternate embodiment, the inner collar 628 includes multiple tabs 638 and the spacing, number, and/or shape of the tabs 638 can vary.

The bottom flange 624 includes a gimbal mounting flange 630 extending in a direction orthogonally or substantially orthogonally to the surface of the bottom flange 624. The rotational collar 626 is coupled to the gimbal mounting flange 630 such that the rotational collar 626 can freely rotate in the circumferential direction of the bottom flange 624. The heat sink 650 is mounted to the gimbal inner collar 628 and a gimbal mounting is provided that permits the heat sink 650 and LED to tilt and swivel in relation to the bottom flange 624.

In an exemplary embodiment, the inner collar 628 includes a bottom wall 632 that extends from the side wall of the inner collar 628 in the direction towards the centerline of gimbal trim unit 610 orthogonally or substantially orthogonally to the direction of the beam path. The bottom wall 632 can include one or more alignment holes 634. In an exemplary embodiment, the alignment holes 634 correspond to a coordinating alignment key of the heat sink 650. In an exemplary embodiment, the alignment holes 634 can include a channel and/or slot configured to receive the corresponding alignment key of the heat sink 650 such that the alignment key can move within the slot-shaped alignment hole 634 as the heat sink 650 rotates within the inner collar 628.

An exemplary inner collar 628 can include one or more columns 636 extending from the interior surface of the inner collar 628 for alignment with the heat sink 650. In an exemplary embodiment, the column 636 is sized and shaped to engage a corresponding notch 652 in the bottom flange 654 of the heat sink 650 (see FIG. 8). In an exemplary embodiment, the spacing, number, and/or shape of the columns 636 can vary. An exemplary column 636 provided in FIGS. 7A and 7B includes a rectangular profile. It is contemplated that the column 636 can have any suitable profile shape, such as round, semi-circular, rectangular, triangular, or oval, for use with aligning the inner collar 628 with the heat sink 650. For example, FIG. 9 illustrates an exemplary inner collar 928 including a column 936 with a round or semi-circular shaped profile.

The column 636 extends along interior surface of the inner collar 628 in a direction parallel to the light path of the LED and/or the centerline of the gimbal trim unit 610. In an exemplary embodiment, the column 636 does not extend fully to the bottom wall 632. Instead, a gap is provided between the bottom wall 632 and the bottom surface of the column 636. In an exemplary embodiment the gap provided between the bottom wall 632 and the bottom surface of the column 636 is sized and shaped to engage a ramped surface 656 of the heat sink 650.

Figure 8:
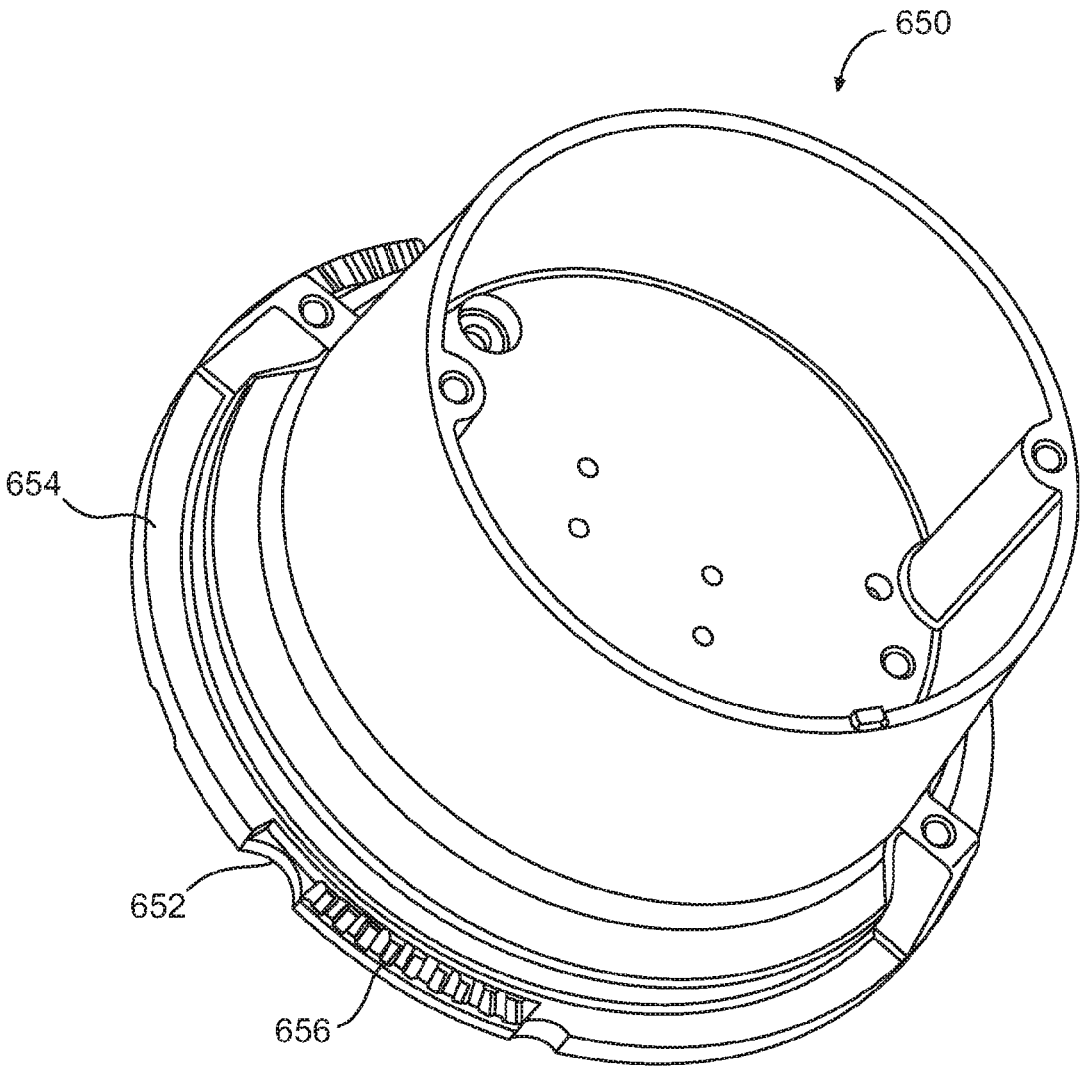
FIG. 8 is a perspective view of a heat sink according to an exemplary embodiment.
Figure 9:
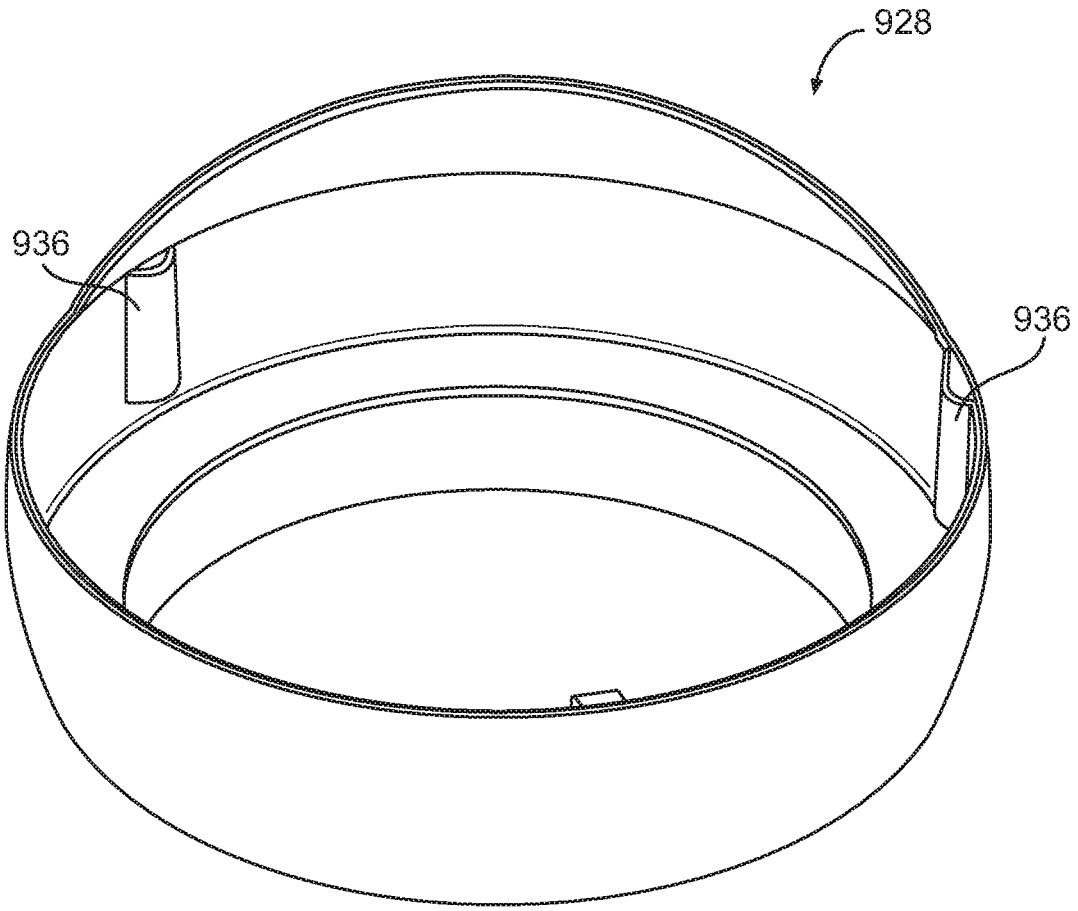
FIG. 9 is a perspective view of a inner collar of a gimbal trim mount according to an exemplary embodiment.

FIG. 8 provides a perspective view of an exemplary heat sink 650. The exemplary heat sink 650 includes a notch 652 and a ramped surface 656 proximate the notch 652. The notch 652 and the ramped surface 656 enable alignment and installation of the heat sink 650 on the inner collar 628 of the gimbal trim unit 610. In particular, the heat sink 650 can be installed on the inner collar 628 by aligning the notch 652 with its corresponding column 636. The heat sink 650 is then moved along the column 636 until the bottom flange 654 is proximate the bottom wall 632. Once in place, the heat sink 650 and/or the inner collar 628 are rotated such that the bottom edge of the column 636 travels up the corresponding ramped surface 656. Each ramped surface 656 has a height that slowly rises along the bottom flange 654 of the heat sink 650. As the bottom edge of the column 636 engages the ramped surface 656, the inner collar 628 and the heat sink 650 are coupled.

The particular embodiments disclosed herein are illustrative only, as the invention may be modified and practiced in different but equivalent manners apparent to those having ordinary skill in the art and having the benefit of the teachings herein. While numerous changes may be made by those having ordinary skill in the art, such changes are encompassed within the spirit and scope of this invention. Furthermore, no limitations are intended to the details of construction or design herein shown. It is therefore evident that the particular illustrative embodiments disclosed above may be altered or modified and all such variations are considered within the scope and spirit of the present invention.

We claim:

1. A luminaire comprising:

a light source;

a heat sink coupled to the light source, the heat sink comprising:

a top surface and a bottom surface that is opposite to the top surface; and an alignment feature integral with the heat sink and protruding from the bottom surface of the heat sink; and a trim removably coupled to the heat sink, wherein the trim comprises:

a first aperture configured to receive light from the light source, a second aperture opposite to the first aperture, and a wall disposed between the first and second aperture, wherein an inner surface of the wall defines a light passageway for the light emitted by the light source; and a top flange extending laterally outward from an upper end of the wall and surrounding the first aperture, the top flange comprising one or more alignment apertures positioned on the top flange and extending through at least a portion of a thickness of the top flange to matingly engage the alignment feature of the heat sink, the alignment aperture corresponding to a size and shape of the alignment feature of the heat sink, wherein the heat sink is removably coupled to and abuts the trim when the alignment feature of the heat sink matingly engages at least one of the one or more alignment apertures of the trim.

2. The luminaire of claim 1, wherein the light source is a light emitting diode (LED) light source.

3. The luminaire of claim 1, wherein the trim further comprises a bottom flange extending laterally outward from a bottom end of the wall and surrounding the second aperture for emitting light received at the first aperture.

4. The luminaire of claim 3, wherein the bottom flange is a trim ring, wherein the trim ring is configured to be disposed at the opening of a surface when the luminaire is installed at the surface.

5. The luminaire of claim 1, wherein the inner surface of the wall comprises a baffle disposed adjacent to a bottom end of the wall and a trim ring.

6. The luminaire of claim 1, wherein the alignment aperture is a through-hole.

7. The luminaire of claim 1, wherein the alignment aperture and the alignment feature are elliptical in shape.

8. The luminaire of claim 1, wherein the heat sink further comprises a channel in the bottom surface of the heat sink, the channel surrounding at least a portion of a perimeter of the alignment feature.

9. The luminaire of claim 1, wherein the alignment aperture comprises a notch in the top end of the wall.

10. A trim for a recessed light fixture, comprising a top wall extending laterally outward from an upper end of the trim and surrounding a first aperture configured to receive a light source, the top wall comprising:

a top surface and a bottom surface that is opposite to the top surface; and an alignment feature extending through at least a portion of a thickness of the top wall between the top surface and the bottom surface for engaging a corresponding alignment feature of a heat sink, wherein the heat sink alignment feature is integral with the heat sink and protrudes from a bottom surface of a mounting flange of the heat sink in a direction of a light path of the light source; and a trim body disposed between the upper end and a lower end of the trim, wherein the bottom surface of the mounting flange of the heat sink is disposed on and abuts the top surface of the top wall of the trim when the alignment feature of the trim engages with the corresponding alignment feature of the heat sink.

11. The trim of claim 10, wherein the trim further comprises a bottom wall at a lower end of the trim surrounding a second aperture for emitting light received at the first aperture, and wherein the bottom wall comprises a trim ring that extends laterally outward from the lower end adjacent to the bottom wall.

12. The trim of claim 10, wherein the trim further comprises a bottom wall at a lower end of the trim surrounding a second aperture, and wherein the bottom wall comprises a trim ring that extends outward and upward from the lower end of the trim body at an angle to the trim body.

13. The trim of claim 10, wherein the alignment feature is a through hole.

14. The trim of claim 10, wherein the alignment feature comprises a depression in the top wall that extends partially through the thickness of the top wall between the top surface and the bottom surface of the top wall.

15. A luminaire comprising:

a heat sink comprising:

a flange at a bottom end of the heat sink, wherein a portion of the flange includes a ramped surface; and an alignment key that is integral with the heat sink and protrudes from a bottom surface of the flange in a direction substantially perpendicular to the flange; and a trim comprising:

an alignment feature that extends from a top end of the trim towards a bottom end of the trim;

a bottom wall extending laterally inward from the bottom end of the trim, the bottom wall including an elongated alignment recess for engaging the corresponding alignment key of the heat sink, wherein the heat sink is coupled to the trim when a bottom surface of the alignment feature engages the ramped surface.

16. The luminaire of claim 15, wherein the elongated alignment recess includes a channel for engaging the corresponding alignment key of the heat sink as the heat sink rotates within the trim.

17. The luminaire of claim 15, wherein the trim further comprises a trim ring extending laterally outward from the bottom end of the trim.

18. The luminaire of claim 15, wherein the trim is a gimbal trim that includes an inner collar and a rotational collar.

19. The luminaire of claim 18, wherein the rotational collar further comprises a tab extending laterally inward from a top surface of the rotational collar toward a light receiving aperture at the top end of the trim, wherein the tab extends over a top surface of the inner collar of the trim and impacts the top surface of the inner collar thereby limiting a tilt of the inner collar and the heat sink.

* * * * *